US005900579A

United States Patent [19]

Hütter et al.

[11] Patent Number: 5,900,579

[45] Date of Patent: May 4, 1999

[54] DISPENSER FOR SCATTERING OF MUNITIONS

[75] Inventors: Horst Hütter, Tegernsee; Siegfried Bock, Kirchseeon, both of Germany

[73] Assignee: LFK-Lenkflugkörpersysteme GmbH, München, Germany

[21] Appl. No.: 07/180,285

[22] Filed: Apr. 7, 1988

[51] Int. Cl.[6] ..... F42B 12/58

[52] U.S. Cl. ..... 102/489; 102/357; 102/393; 102/473

[58] Field of Search ..... 102/383, 393, 102/340, 342, 351, 357, 473, 489; 89/1.35, 1.703, 8

[56] References Cited

U.S. PATENT DOCUMENTS 1,559,183 10/1925 Rimailho ..... 89/1.35

3,946,637 3/1976 Campagnuolo ..... 89/1.703

FOREIGN PATENT DOCUMENTS 3500163 4/1986 Germany .

*Primary Examiner*—Harold J. Tudor

*Attorney, Agent, or Firm*—McGlew and Tuttle, P.C.

[57] ABSTRACT

The invention is directed to a dispersal or scattering dispenser (cannister) in accordance with the species concept of claim 1, in which the muzzle velocity of the munitions can be changed during the munitions ejection in a target dedicated manner by the chronologically phased opening of a pressure chamber arranged between the gas generator and the munitions tube. Embodiment examples are described and illustrated in the figures of the drawing.

6 Claims, 7 Drawing Sheets

OPENING
ARRANGEMENT
NOT ACTUATED

PRESSURE CHAMBER
OPENED AFTER
0.005 SEC.

INSTANT OF OPENING
CORRESPONDING TO
THE TARGET DATA

DISPENSER FOR SCATTERING OF MUNITIONS

BACKGROUND OF THE INVENTION

The invention is directed to a dispenser (cannister) for scattering or dispersing of munitions which is composed of a plurality of tube groupings for receiving the munitions to be dispersed.

Such scattering dispensers have already become known in various embodiments. In DE-PS 35 00 163, a dispersing dispenser is disclosed in which, respectively, the first ejection tubes of a tube grouping are connected with a collective gas generator and where the tubes available after ejection of the munitions serve, respectively, as compressed gas reservoirs for the ejection tubes which must be respectively next supplied with compressed gas. By this special design, a uniform coverage of the dispersing surface is achieved whereby the energy consumption is reduced compared to other systems. Various possibilities are proposed for the required velocity variation, for instance, by producing the compressed gas still beyond the ejection process, wherein the munitions space just liberated serves as an additional compressed air reservoir or that additionally a so-called buffer reservoir is filled which communicates with a respective first ejection tube or with additional ejection tubes. Furthermore, throttling points or outlet apertures are provided in the gas communication channels.

SUMMARY OF THE INVENTION

The present invention builds upon the state of the art and solves the problem of determining the ejection speeds for the munitions ejection which, hitherto, had always been fixed beforehand, independently and in a respective freely selectable and adjustable manner.

Refinements and developments are stated in the dependent claims, embodiment examples are explained in the following description and they are sketched in the figures of the drawing. It is shown on:

DETAILED DESCRIPTION OF THE INVENTION

Figure 1:
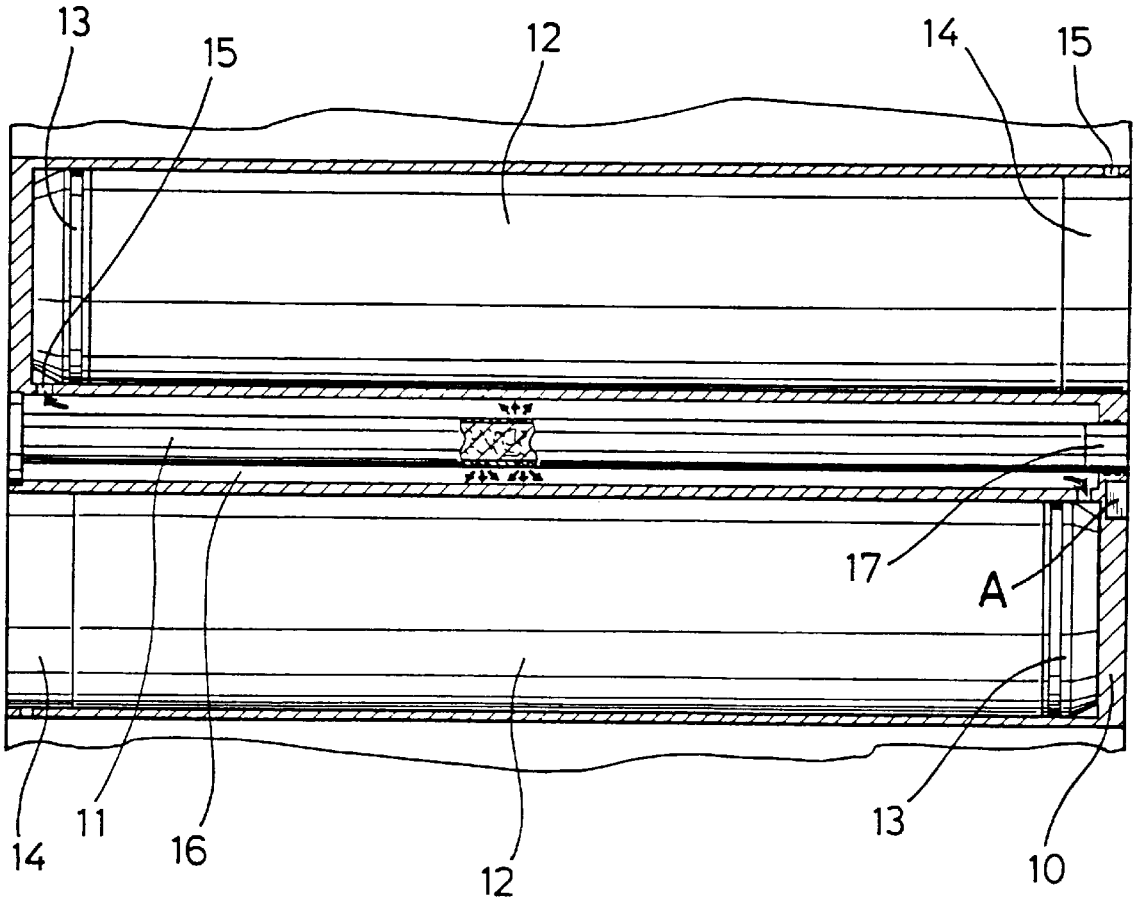
FIG. 1 a cross section through a portion of a tube grouping.

FIG. 1 shows a tube grouping 10 of a dispersing cannister (dispenser) for munitions stores known as such. These munitions are stored in individual tubes in such a way that the tube ejection aperture or the tube muzzle is once oriented to one end and the next time to the other end, so that an area coverage on both ends of the dispersing cannister placed in the flight direction can occur in the known manner. In the embodiment shown, a so-called buffer space 16 is arranged between two tubes and parallel to them, in which buffer space a gas generator 11 is located. The buffer space 16 is provided with an opening arrangement 17 on one side which is in connection with a safety- and actuation arrangement A. The individual tubes with their munitions 12 stored therein have respectively one cartridge case base 13 for munitions ejection and a restraining device 14 for these munitions 12. Furthermore, overflow channels 15 for the propellant gas are arranged between tubes and from tubes to the buffer space.

Figure 2:
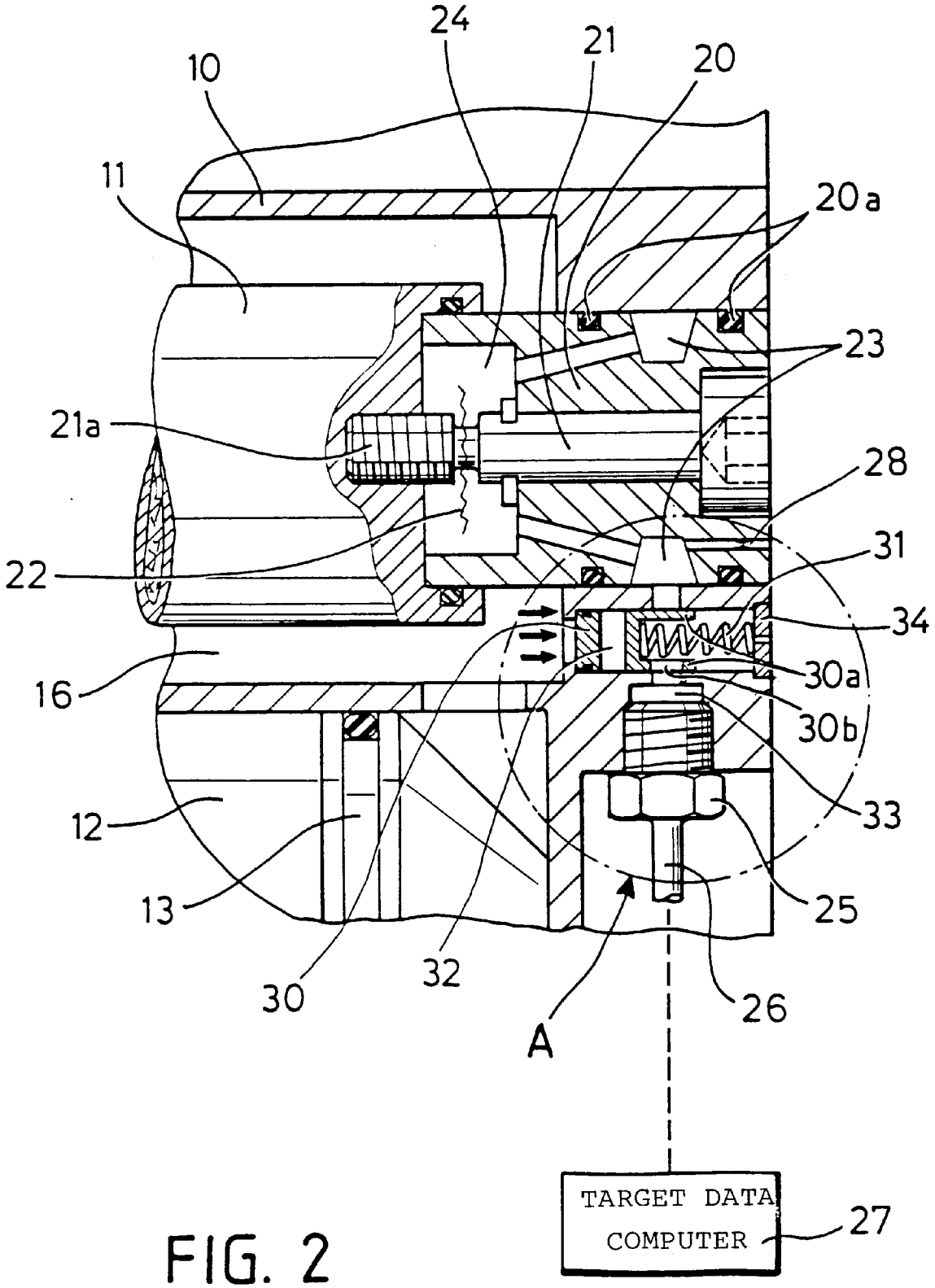
FIG. 2 a partial cross section of the tube end portion in FIG. 1 in magnified illustration, FIG. 3 a partial cross section through FIG. 2, wherein the safety- and actuation arrangement is in a position in which an unintentional ignition has occurred, FIG. 4 a partial cross section of FIG. 2, wherein the safety- and actuation arrangement is in the position in which a maximum ejection velocity with nonactivated fuse cap exists, FIG. 5 a partial cross section according to FIG. 2, wherein the safety- and actuation arrangement is in the position in which a target oriented ejection velocity exists, FIG. 6 a partial cross section according to FIG. 2 where the state at instantaneous pressure drop is depicted.

FIG. 2 now shows the end portion of the buffer space 16 and the munitions tube or housing of the dispenser 10 in which the aperture arrangement 17 and the safety- and actuation appliance A are arranged.

The front face or end of the gas generator 11 facing the aperture arrangement 17 is equipped with a so-called plug 20 which, on the one hand, is supported in a sealing manner in a corresponding bore of the housing of the dispenser 10 and, on the other hand, is connected with this front face by means of a shear bolt 21. This shear bolt 21 has a screw thread 21*a* in its end portion and a deep annular groove acting as a rated break point 22 in the region of the subsequently described pressure chamber 24. The plug 20 which, with its seals 20*a* seals off the buffer space 16, is provided with a cavity at its end facing inwards which is designed as the pressure chamber 24 for the compressed air coming from the safety- and actuation arrangement A and acting upon the rated break point. So-called ignition channels 23 are arranged opening into the pressure chamber 24. A second bore for the safety- and actuation device A is directly adjacent to the bore in the housing of the dispenser 10 intended for the plug 20. A safety element 30 is displaceably arranged in this bore. This element is provided with a bore as a pass-through channel 32 for the compressed gas coming from the fuse cap 25 as well as being equipped with sealing elements 30*a*, which elements cover the otherwise existing free space between the ignition space 33, the fuse cap 25 and the ignition channel 23 in the plug 20. This safety element 30 abuts by means of a compression spring 31 against a barrier plate 34 which covers the bore for the safety element in the housing. Transversely to this bore in the axis of the ignition channel 23 there exists an additional bore in the dispenser housing in which the fuse cap 25 is fastened. This bore is of such depth that an ignition space 33 is additionally formed above the fuse cap 25. The fuse cap itself is connected with the on-board target data computer through an ignition pulse transmission cable 26. This computer activates or blocks the fuse cap depending on the determined target data.

Figure 3:
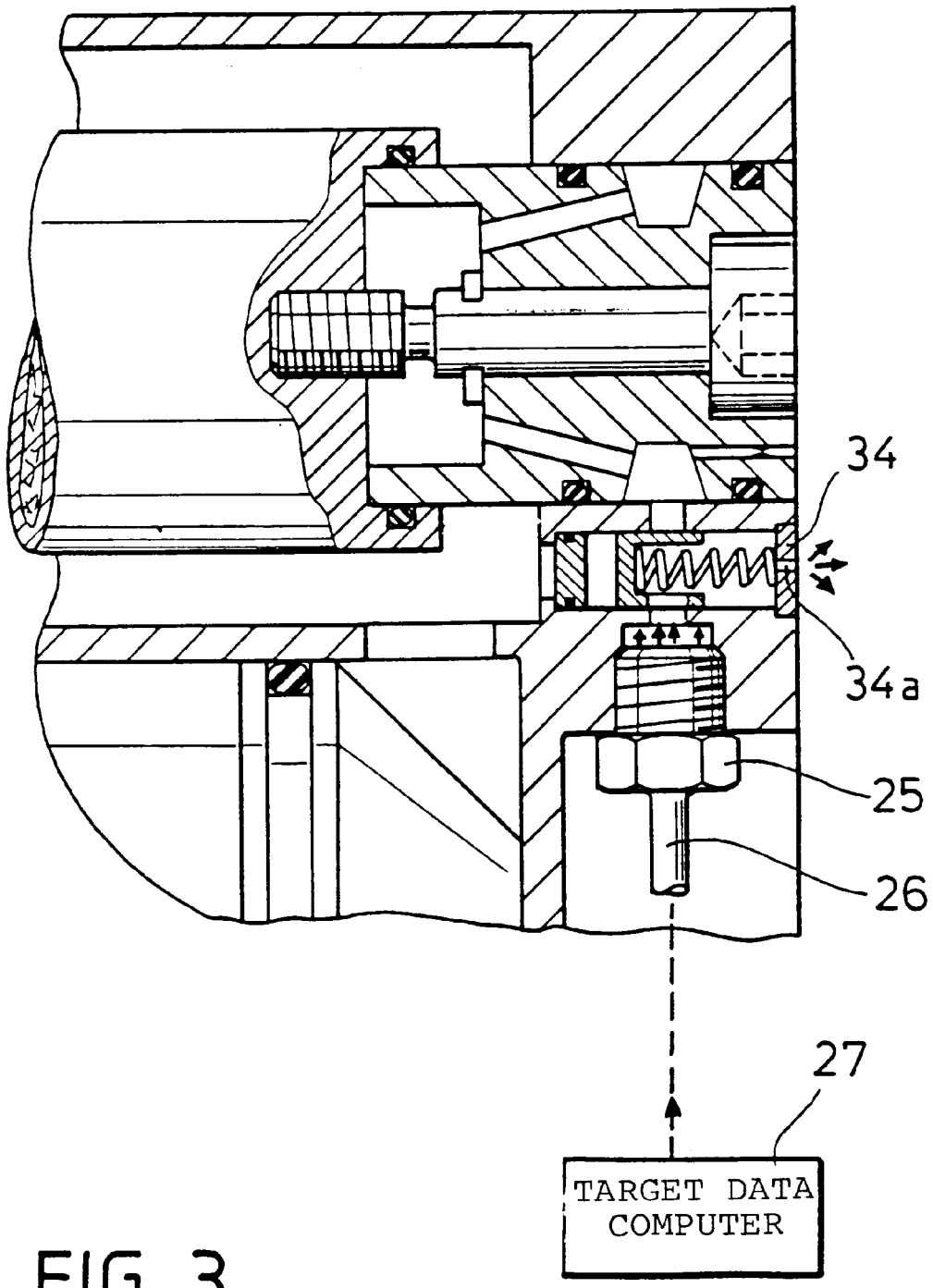

FIGS. 3 to 6 illustrate separate functional positions of the safety- and actuation arrangement. Herein, FIG. 3 shows the situation where, indeed, a firing of the fuse cap 25 occurs which, however, for the moment, for instance, out of tactical considerations,is not desired. In this case, where the gas generator 11 is not activated and therefore the buffer space 16 is devoid of gas and correspondingly also no force for displacement of the safety element 30 is available, the upper sealing element 30*a* of the safety element closes off the ignition channel 23, while the bore 30*b* in the lower sealing element directs the undesirable ignition gas flow into the spring space of the bore for the safety- and actuation device A and onto the barrier plate 34, where the flow can escape into the surrounding air through the bores 34*a* in the barrier plate.

Figure 4:
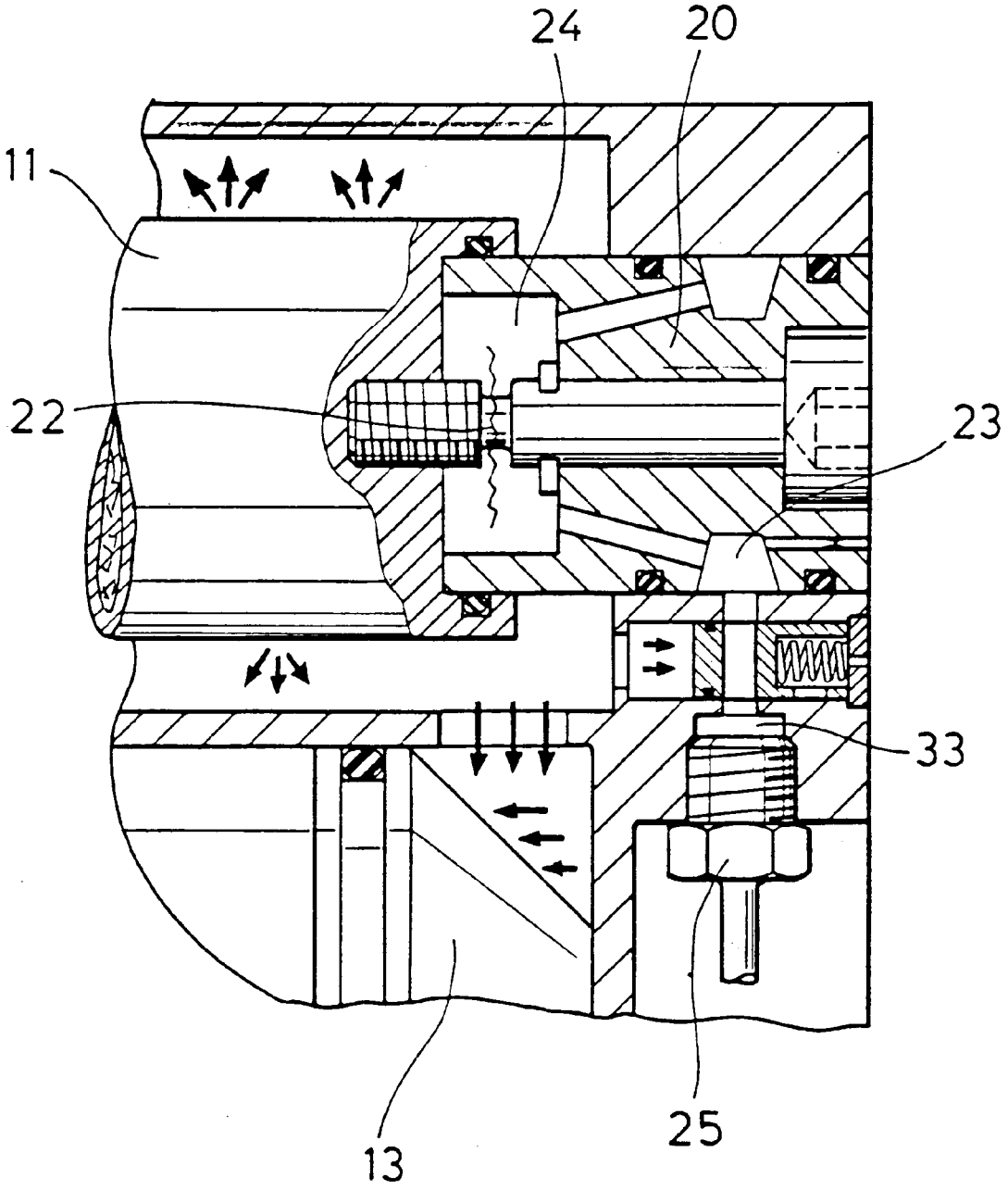
Figure 5:
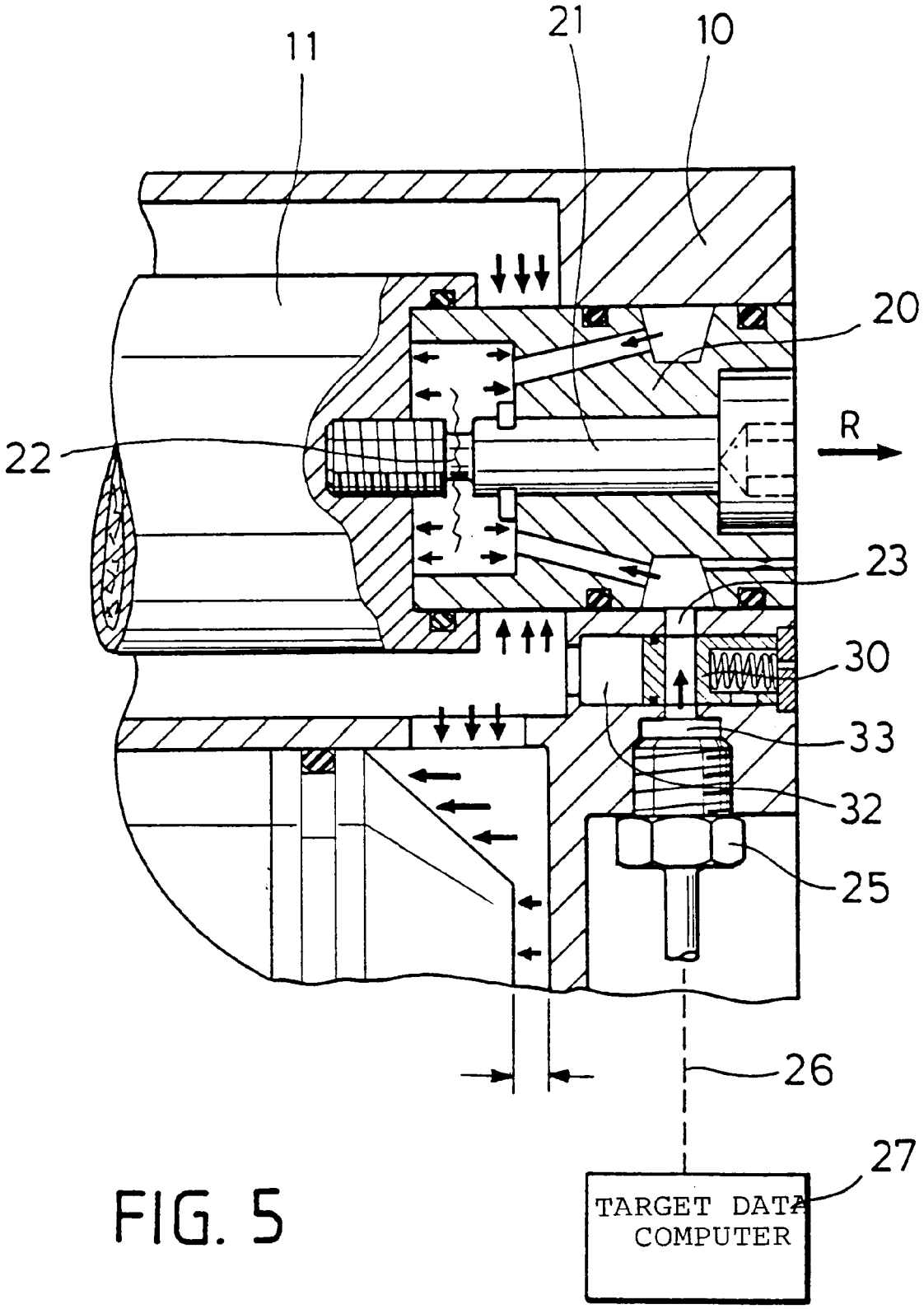
Figure 6:
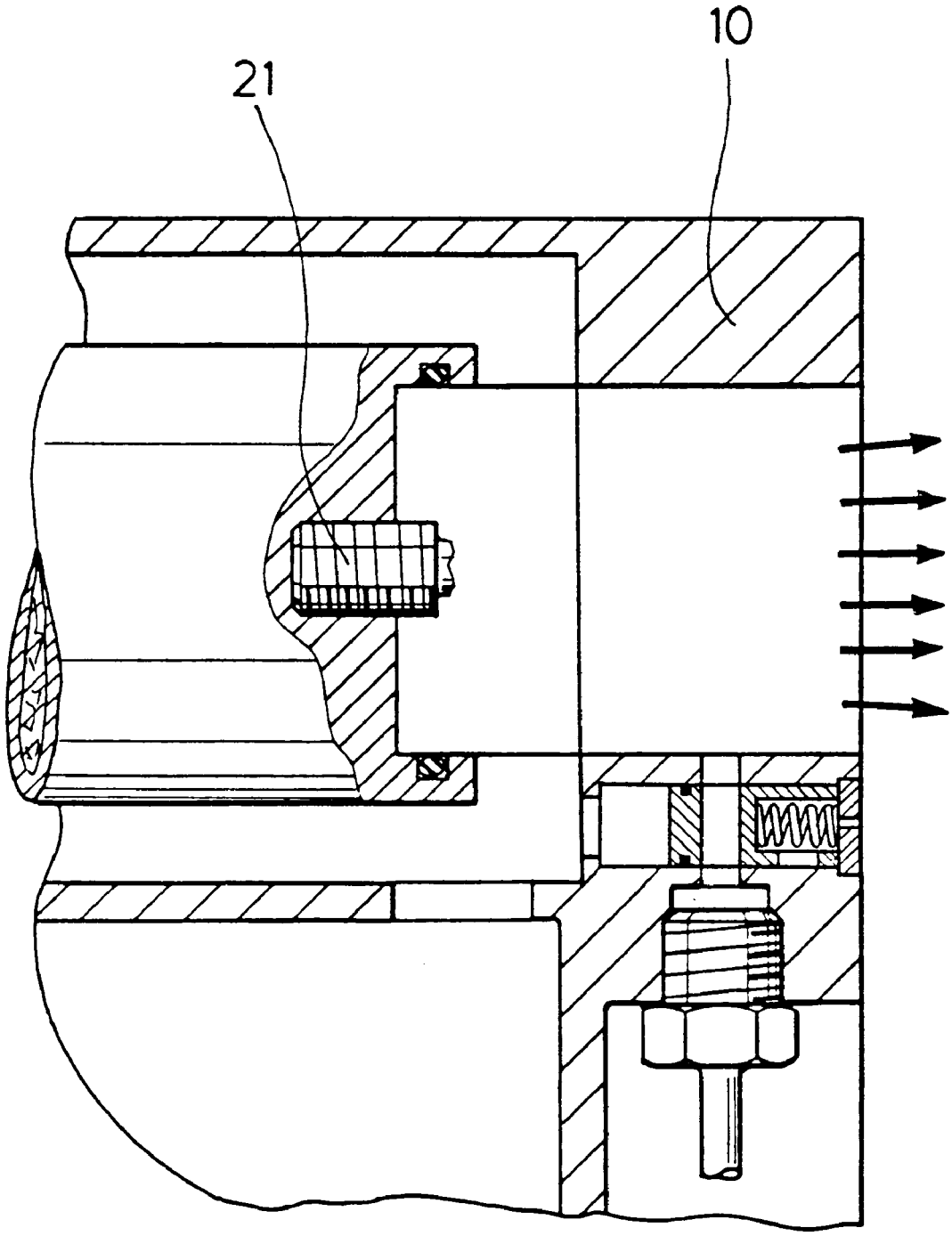
Figure 7A:
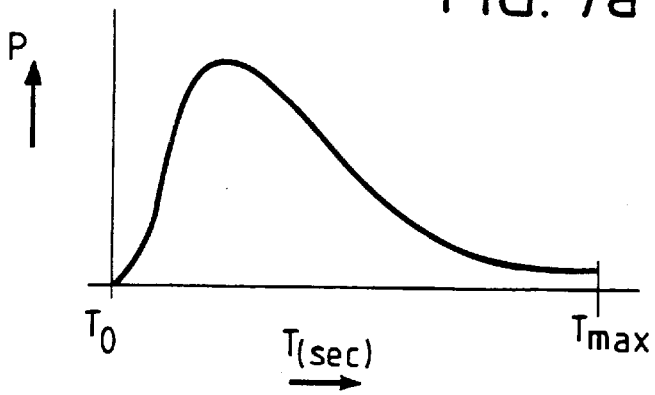
FIG. 7*a* shows a diagram for the maximum ejection velocity, FIG. 7*b* a diagram for the minimum ejection velocity, FIG. 7*c* a diagram for the target oriented ejection velocity.
Figure 7B:
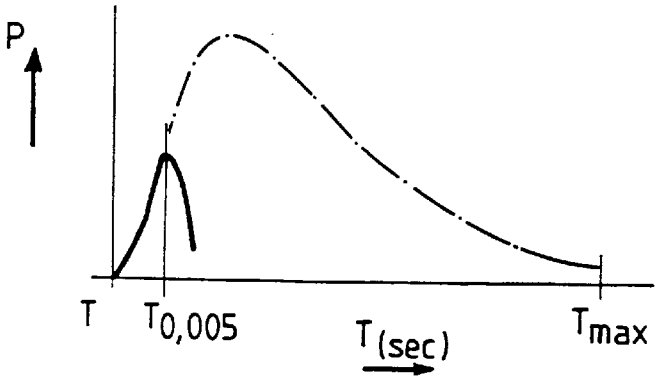
Figure 7C:
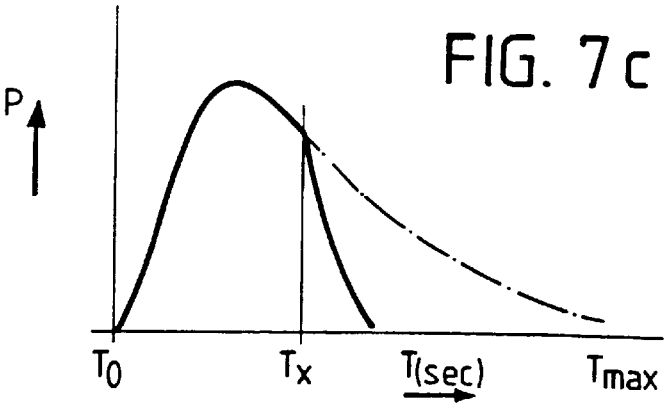

FIG. 4 illustrates a situation in which the maximum ejection velocity exists and the fuse cap 25 is not activated. The gas produced in the gas generator 11 penetrates from the buffer space 16 on the one hand into the connected munition tubes of the dispenser 10 and presses there upon the cartridge case base 13 and on the other hand on the safety element 30 and displaces same against the pressure of the spring 31 until the bore registers with the outlet of the ignition space 33 and the ignition channel 23. Now the muzzle velocity of the munitions can be changed at any time during the operation process by the target data computer 27 and the fuse cap 25, thus as it were a target dedicated ejection velocity can be achieved. The functional position then existing in the dispenser is illustrated in FIG. 5. The target data computer has acquired a specific target within the scattering area and transmits the ignition pulse setting based on the values of this target and activates the fuse cap at the necessary appointed time; the gas pressure originating from the fuse cap fractures the shear bolt 21 and thus leads to the immediate ejection of the plug 20 in the direction R. Through this, the pressure chamber or the buffer space is opened and an immediate pressure drop is achieved. FIG. 6 shows the situation in this case. The pressure time diagrams depicted in FIGS. 7*a*–7*b* illustrate the individual curves of the magnitude of the maximum ejection velocity (FIG. 7*a*), for the minimum ejection velocity (FIG. 7*b*) and for the target dedicated ejection velocity (FIG. 7*c*). The diagrams can speak for themselves so that no additional explanations are required concerning them. It should be evident that the probability of hitting the target is considerably improved by the proposed measures and thus that a non negligible combat effectiveness increase of scatter-type weapons is achieved.

We claim:

1. Dispenser for scattering munitions comprises a housing, a plurality of groups of tubes located within said housing with the tubes arranged to hold the munitions to be scattered during transportation and during ejection of the munitions, each said group of tubes comprises a plurality of elongated parallel tubes each having a pair of opposite ends, at least two adjacent said tubes being in spaced relation and forming a buffer space therebetween, a gas generator having a pair of opposite ends extending in generally parallel relation with said tubes and located within the buffer space for generating compressed gas and supplying the compressed gas into the buffer space for use in ejecting the munitions, each said tube having a restraining device at one end and a propelling piston at the other end for displacement in the elongated direction of said tube for displacing the restraining device out of the tube and displacing the munitions out of the tube, gas passages in said tubes for affording a flow of compressed gas from the buffer space into and through said tubes, wherein the improvement comprises that said gas generator and housing form a closed pressure chamber at one end of said gas generator, safety and actuation means in controlled communication with said pressure chamber for selectively opening said pressure chamber, sealing means in said housing for forming a sealed closure for said pressure chamber, said safety and acutations means arranged for selectively displacing said sealing means out of said housing, said safety and actuation means including means for supplying compressed gas to said pressure chamber for displacing said sealing means and opening said pressure chamber.

2. Dispenser, as set forth in claim 1, wherein said sealing means comprises a plug fitted into said housing, a shear bolt secured in said plug and extending through said pressure chamber and secured in the adjacent end of said gas generator, said safety and actuation means comprises an ignition space, a safety element located between said ignition space and said plug, a gas channel in said plug extending between said pressure chamber and said safety element, and said means for supplying compressed gas to said pressure chamber located in commication with said ignition space.

3. Dispenser, as set forth in claim 2, wherein said means for supplying compressed gas to said pressure chamber comprises a fuse cap located in said ignition space, said safety element being displaceably mounted for movement out of a path connecting said ignition space and said ignition channel whereby said safety element can be displaced from a first position blocking flow between said ignition space and said ignition channel and a second position emitting flow between said ignition space and said ignition channel.

4. Dispenser, as set forth in claim 3, wherein said safety element is located in a bore in said housing adjacent said plug, and said bore being open to said buffer space.

5. Dispenser, as set forth in claim 4, wherein said safety element includes at least one sealing element for blocking flow from said ignition space to said ignition channel.

6. Dispenser, as set forth in claim 4, comprising a data target computer, an ignition pulse transmission cable connecting said fuse cap to said target data computer for selectively igniting said fuse cap for supplying compressed gas to said pressure chamber for selectively displacing said plug out of said housing and opening said pressure chamber for controlling displacement velocity of the munitions.

* * * * *